US006727216B1

(12) United States Patent
Waeschenbach et al.

(10) Patent No.: US 6,727,216 B1
(45) **Date of Patent: *Apr. 27, 2004**

(54) COMPOSITION FOR USE IN A LAUNDRY WASHING MACHINE

(75) Inventors: Guido Waeschenbach, Oakland, NJ (US); Ralf Wiedemann, Griesheim (DE); Enric Carbonell, Barcelona (ES); Paul W. Robinson, North Ferriby (GB); Antonio Cordellina, I-Abano (IT); Manuela Bosco, Castagnole di Paese (IT); Giorgio Franzolin, Scaltenigo (IT); Joan Clotet, Barcelona (ES); Dora Zamuner, Venice (IT)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/744,723

(22) PCT Filed: Jul. 29, 1999

(86) PCT No.: PCT/TR99/00035

§ 371 (c)(1),
(2), (4) Date: Apr. 4, 2001

(87) PCT Pub. No.: WO00/06689

PCT Pub. Date: Feb. 10, 2000

(30) Foreign Application Priority Data

Jul. 29, 1998 (DE) ..... 198 34 181

(51) Int. Cl.[7] ..... C11D 17/00; D06L 1/00

(52) U.S. Cl. ..... 510/298; 510/294; 510/446; 510/475; 8/137

(58) Field of Search ..... 510/294, 298, 510/446, 475; 8/137

(56) References Cited

U.S. PATENT DOCUMENTS 3,924,622 A * 12/1975 Brooke ..... 128/260
4,082,678 A 4/1978 Pracht et al. ..... 252/8.6
4,801,636 A * 1/1989 Smith et al. ..... 524/236
4,972,017 A * 11/1990 Smith et al. ..... 524/46
5,360,567 A * 11/1994 Fry et al. ..... 510/298
6,358,911 B1 * 3/2002 Metzger-Groom ..... 510/446
6,514,429 B1 * 2/2003 Waschenbach et al. ..... 252/181

FOREIGN PATENT DOCUMENTS

DE 236030 6/1911
DE 2 065 153 10/1972 ..... C11D/17/00
DE 9607401 A1 * 3/1996

(List continued on next page.)

OTHER PUBLICATIONS

Abstract: JP 60–141705 dated Jul. 26, 1985.
Abstract: JP 61–28440 dated Feb. 8, 1986.
Abstract: JP 61–28441 dated Feb. 8, 1986.
Abstract: JP 61–28596 dated Feb. 8, 1986.
Abstract: JP 61–28597 dated Feb. 8, 1986.
Abstract: JP 61–28598 dated Feb. 8, 1986.
Abstract: JP 50–77406 dated Jun. 24, 1975.

*Primary Examiner*—Lorna M. Douyon
(74) *Attorney, Agent, or Firm*—Akin Gump Strauss Hauer & Feld LLP

(57) ABSTRACT

The invention relates to a composition for use in a washing machine. The composition is characterised by a base composition that becomes active essentially during the main wash cycle of the washing machine; and by at least one particle with at least one core which contains at least one substance which becomes active essentially during the rinse cycles of the washing machine and with a coating which essentially fully encloses the core(s) and contains at least one compound whose solubility increases as the concentration of a specific compound in the surrounding medium decreases. The invention provides for means that prevent a significant dissolution of the coating or a significant detachment of the coating from the core(s) until the rinse cycles have begun. The invention also relates to a method for carrying out a wash cycle in a washing machine using the inventive composition.

42 Claims, 2 Drawing Sheets

FOREIGN PATENT DOCUMENTS

Figure 1:
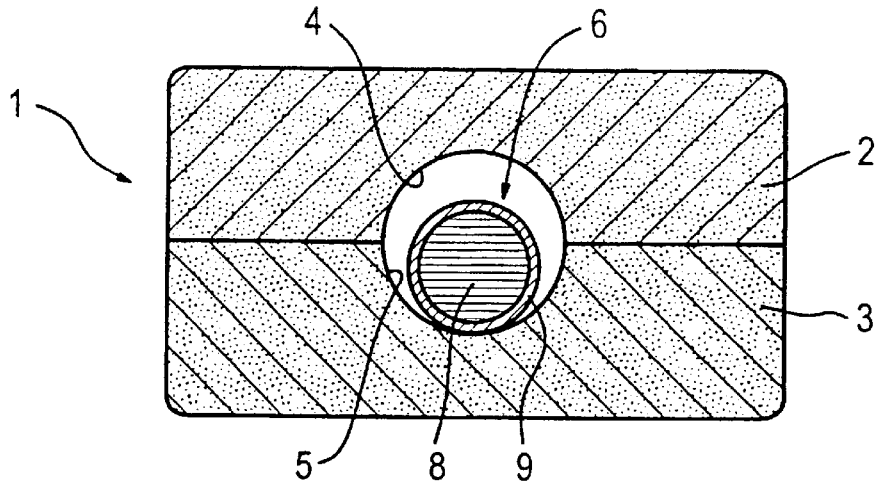

| | | | | |
|---|---|---|---|---|
| EP | 0 284 191 B1 | | 9/1988 | ..... B65D/65/38 |
| EP | 0 481 547 A1 | | 4/1992 | ..... C11D/17/00 |
| EP | 0 284 334 A2 | | 9/1998 | ..... C11D/17/00 |
| GB | 1 307 387 | | 2/1973 | ..... C11D/11/00 |
| GB | 1 390 503 | | 4/1975 | ..... C11D/11/00 |
| JP | 60141706 | | 7/1985 | ..... C08F/36/04 |
| JP | 09175992 | A2 * | 7/1997 | |
| WO | WO 92/20774 | A1 * | 11/1992 | |
| WO | WO95/29982 | | 11/1995 | ..... C11D/17/00 |
| WO | WO 99/27067 | A1 * | 6/1999 | |

* cited by examiner

COMPOSITION FOR USE IN A LAUNDRY WASHING MACHINE

The present invention relates to a composition for use in a washing machine and to a process for the use thereof.

Although modern washing machines usually have numerous different washing programs, which differ with respect to the duration and temperature of the individual washing and rinsing cycles, a washing programs essentially comprise the following basic steps: prewashing cycle, main washing cycle, several rinsing cycles and spinning cycle. Whilst the actual detergent which is intended to give rise to the cleaning action is added at the start of the main washing cycle (or optionally at the start of the prewashing cycle), during the rinsing cycles special agents with different functions can be used. These special agents for the rinsing cycles are intended to mainly bring about further advantages for the washing treatment. A non-exhaustive list of such agents and without restriction thereto comprises fragrances (pleasant smell of the washing), fabric softeners (softness of the washing), antistatic agents reduction or prevention of the build-up of static electricity in the washing), agents for restoring the capacity of the washing to absorb moisture, mild acids (beaking down incrustations or neutralization of alkalinity), bleaches, either having an oxygen or a chlorine base (improving the cleaning action), disinfectants, agents for a persistent protection of both the washing and the person wearing the latter against insects or cites, agents for an improved removal of grease marks, finishing agents giving a protection against creasing, optical brighteners, ironing auxiliaries (to facilitate ironing of the washing), agents for inhibiting dye transfer, enzymes such as cellulases, lipases, etc. for special uses.

The described different functionalities have hitherto been achieved (if at all) by charging different products, partly via separate dosing or charging devices, as well as charging at different times.

The aim of the present invention was to combine within a single product the cleaning function and the function or functions of the substance or substances to be added during the rinsing cycles, with a constant efficiency compared with the results achievable with a separate dosing or charging, or to permit the charging of further substances in the rinsing cycles. DE-OS 20 65 153 and DE-OS 20 07 413 disclose detergent pellets for use as washing agents, in which it is inter alia provided to combine two components with different functionalities. The structure is formed from a covering or enveloping shell, which is e.g. formed from two shell halves, which comprise a cleaning agent, and a cavity surrounded by the shells and which contains additives such as softeners, brighteners, etc.

British patent 1 390 503 discloses a liquid cleaning agent or detergent which contains capsules, which are insoluble in the composition, but release their content when the composition is diluted with water. This objective is achieved in that the capsules are coated with a substance, which has a poor solubility in water solutions with a high ionic strength, but which is soluble if the ionic strength is reduced by dilution. It is pointed out that this procedure can be used in order to incorporate materials into the liquid cleaning agent, which in the latter are unstable or would produce an instability if added directly. It is also proposed to use this procedure for delaying the release of a specific substance. Reference is made to use in detergents. The encapsulated material is released within two minutes following the dilution of the cleaning agent with water, i.e. during the main washing cycle.

U.S. Pat. No. 4,082,678 describes a fabric conditioner, which comprises a closed container containing a releasable agent and which is used for making water-insoluble or non-dispersible an inner container located in the first container and which is normally water-soluble or water-dispersible, the inner container containing a fabric conditioner. The inner container comprises a substance, whose solubility in water is highly dependent on the ionic strength or the pH-value of the medium and the agent used for rendering the inner container insoluble is an agent for controlling the pH-value or the ionic strength.

Japanese patent applications KOKAI 60-141705, 61-28440, 61-28441, 61-28596, 61-28597 and 61-28598 describe processes for the production of pH-sensitive microcapsules for use in detergents. The pH-sensitive coating is a copolymer of the following monomers:

A) at least one basic monomer of formula I:

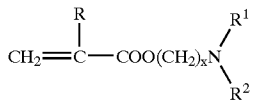

(I)

in which R is hydrogen or a methyl group and $R^1$ and $R^2$ in each case an alkyl group with 1 to 3 carbon atoms and x is an integer from 1 to 4, B) at least one monomer which is insoluble or difficultly soluble in water and C) at least one water-soluble monomer.

It is pointed out that the described polymers are insoluble at a pH-value of 9.5 or higher and are soluble at a pH-value of 8.5 or lower. Different ingredients of cleaning agent compositions are described, which can be successfully and usefully coated with, the described polymers. The aim of the invention described therein is to protect substances, which only evolve their function during the rinsing process up to the start of the latter and then to release them as immediately as possible. A disadvantage of the solution described in these Japanese patent applications is that the enveloped particles are in direct contact with non-alkaline washing water at the start of the washing cycle, which can give rise to a partial dissolving of the protective covering.

Japanese patent KOKAI 50-77406 discloses a washing aid, which is surrounded by a water-soluble covering or envelope, obtained by mixing polyvinyl acetal dialkyl aminoacetate and at least one organic acid, which is solid at room temperature. This protective envelope is intended to protect the washing aid during the main washing cycle one to release it during rinsing cycles. The described compound reacts to the pH-value change between the main washing cycle and the rinsing cycle. Here again the disadvantage exists of a possible partial dissolving of the protective envelope at the start of the washing cycle.

European patent applications EP 284 191 A2 and EP 284 334 A2 disclose a water-soluble polymer film for releasing washing additives during the rinsing cycle of washing machines, remaining intact during the normal washing cycle over a range of typical temperatures and rapidly dissolving during the rinsing cycle. These applications point out that the use of pH-sensitive coatings was admittedly known, but that these films are normally also temperature-sensitive, so that they do not remain reliably stable during the different temperatures of the washing cycle. The solution proposed is a pH-dependent material (which undesirably also has a positive, temperature-dependent dissolving behaviour) which is combined with a material having a negative, temperature-dependent dissolving behaviour. This combination is supposed to guarantee that the coatings do not dissolve at the high temperatures at the start of the washing cycle (in particular the very high temperatures occurring in American machines).

European patent application EP 481 547 A1 discloses multilayer dishwashing machine tablets having a core, a separating layer surrounding the core and an outer layer for the sequential release of the ingredients of the different layers. This tablet is fundamentally intended to solve two problems, namely 1) incompatible materials can be formulated together in a single tablet and released at different times in order to avoid mutual influencing and
2) compositions, which are intended to evolve their functions at different times, can be formulated in a single tablet.

An essential disadvantage of this prior art is that for initiating dissolving of the covering layer the temperature is used as the initiating factor, i.e. temperature-sensitive materials are used for the covering material. As the temperature/time pattern in washing machines can differ very considerably as a function of the selected program it would be difficult, if not impossible, to select a material for the covering which is usable for all possible programs of modern washing machines. EP 481 547 A1 admits (p 7, lines 37 to 43) that the choice of the material of the covering layer must take account of equipment and program-specific features. Thus, there is a clear limitation to he practical usability of the products described. The citation makes to mention of a use for washing machines.

PCT application WO 95/29982 discloses a dishwashing agent with a delayed release of a clear rinsing agent in the form of a nonionic surfactant, which together with an inorganic builder salt forms a core particle, which is provided with a wax-like covering in order to ensure the delayed release. This covering is a substance which does not melt at the operating temperatures encountered during the cleaning cycle, but which at alkaline pH-values is so gradually chemically disintegrated that there is still an effective clear rinsing agent quantity present at the end of the main cleaning cycle and is transferred into the rinse clear cycle. The citation makes no mention of a use for washing machines.

A disadvantage of the solution described in this citation is that the covering is rendered soluble by chemical saponification at alkaline pH-values, so that the time at which the clear rinsing substance is released from the core is a function both of the temperature and the length of the main cleaning cycle. The patent application provides no teaching as to how a product is to be formulated with which the clear rinsing agent can be released in the rinsing cycle in all washing programs of any random equipment type. Finally the product is a mixture of granular cleaning agents and granular clear rinsing particles.

In view of the prior art, the problem of the present invention is to provide a composition according to the preamble, which is usable for most washing programs of different washing machine types and in each of the said cases only releases the substance or substances intended to exert their action substantially firstly in the rinsing cycles only in said cycles. The aim is to achieve this without any significant restriction regarding the choice of detergents used, the substance or substances used for the rinsing cycles and other constituents of the composition.

According to the invention this problem is solved with a composition according to the preamble, which is characterized by a basic composition evolving its function essentially in the main washing cycle of the washing machine, and at least one particle with at least one core incorporating at least one substance, which evolves its function essentially in the rinsing cycles of the washing machine, and a covering substantially completely surrounding the core or cores, which comprises at least one compound, whose solubility increases with decreasing concentration of a specific compound in the surrounding medium, agents being provided so as to prevent up to the start of the rinsing cycles any significant dissolving of the covering or significant detachment of the covering from the core or cores.

In an advantageous embodiment the concentration of the specific compound in the local environment of the particle or particles is sufficiently high up to the start of the rinsing cycles to prevent up to this time a significant dissolving of the covering and a significant detachment of the covering from the core or cores.

Preferably the particles are coated with a substance which, substantially independently of the concentration of the specific compound in the surrounding medium, is dissolved or separated during the rinsing cycles of the washing machine.

Preferably the basic composition is in the form of a tablet.

An embodiment of the invention proposes that at least one particle is so placed in or on the tablet that the concentration of the specific compound in the local environment of the particle or particles is sufficiently high up to a substantially complete dissolving of the tablet in order to prevent a significant dissolving of the covering or a significant detachment of the covering from the core or cores.

Preferably the or all the particles are received in at least one cavity of the tablet completely surrounded by the basic composition.

At least one cavity contains one or more particles, which alone or together substantially have the same volume as the cavity.

Preferably at least one cavity has a larger volume than the or all the particles received in the particular cavity.

In an alternative of the invention the particle or particles are loosely located in the interior of the cavity.

In another alternative the particle or particles are fixed in the interior of the cavity, preferably by an adhesive.

In a further embodiment the cavity is substantially centrally placed in the interior of the tablet.

The invention also proposes that -he tablet has a single, substantially spherical cavity.

According to the invention it is preferable to receive in the cavity a single, substantially spherical particle, whose external diameter is smaller than the internal diameter of the cavity.

In a further embodiment the or all the particles are received in at least one tablet cavity, which is only partly surrounded by the basic composition.

Preferably the cavity is a depression in one of the tablet surfaces in which the particle or particles are at least partly received.

In a preferred embodiment the particle or particles are so received in the cavity or depression that they do not project over the surface or surfaces of the tablet.

In a special embodiment, the invention proposes that the cavity or depression only contains a single tablet, whose volume and shape in the vicinity of the cavity or depression substantially coincides with the volume and shape of the cavity or depression and substantially completely fills the same.

Preferably the cavity or depression has a substantially circular cross-section face parallel to one of the surfaces to which it opens or in which it is placed.

The invention also proposes that the cavity or depression only opens to such an extent towards the surface or surfaces that the particle or particles received therein cannot pass through the opening or openings of the cavity or depression.

Preferably the particle or particles are loosely arranged in the cavity or depression.

In another alternative the particle or particles are fixed in the cavity or depression, fixing preferably taking place with an adhesive.

In an embodiment of the invention, the basic composition comprises at least one composition selected from the group comprising a detergent composition, a water softener composition and a washing intensifier composition.

In a preferred embodiment of the invention, the covering comprises at least one compound, which at the concentration of the specific ion at the end of the main washing cycle of the washing machine is not or is only slightly soluble and at the concentration of the specific ion in the rinsing cycles has such a sufficient solubility that it is so substantially dissolved in the rinsing cycles or detached from the core or cores that an at least partial escape of the core material into the medium of the rinsing cycles is permitted.

Preferably the solubility of the compound increases with decreasing $OH^-$ ionic concentration and therefore decreasing pH-value in the surrounding medium.

In particularly preferred manner the compound has at a pH-value above 10 no or only a limited solubility and at a pH-value below 9 such an adequate solubility that it is so substantially dissolved in the rinsing cycles or is so detached from the core or cores that an at least partial escape of the core material into the medium of the rinsing cycles is permitted.

Preferably this compound comprises a polymer, in particularly preferred manner a pH-sensitive polymer, which comprises at least one repeat unit, which has at least one basic function, which is not part of the backbone chain of the polymer.

In a preferred embodiment the polymer comprises at least one repeat unit, which is based on a compound selected from the group comprising vinyl alcohol derivatives, acrylates or alkyl acrylates having said basic function.

According to the invention the polymer is a carbohydrate functionalized with said basic function.

The aforementioned basic function is preferably an amine, in particularly preferred manner a secondary or tertiary amine.

According to a preferred alternative the repeat unit is based on a compound having the following formula III:

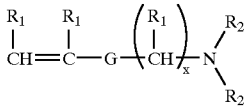

(III)

in which G is a linking group selected from —COO—, —OCO—, —CONH—, —NHCO—, —NHCONH—, —NHCOO—, —OCONH—or —OCOO—, $R_1$ independently of one another being hydrogen or an alkyl group with 1 to 3 carbon atoms, $R_2$ independently of one another hydrogen or an alkyl group with 1 to 5 carbon atoms and x is an integer from 1 to 6.

Preferably the repeat unit is based on a compound with the following formula IV:

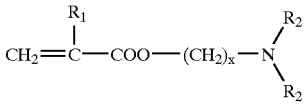

(IV)

in which $R_1$ independently of one another is hydrogen or am alkyl group with 1 to 3 carbon atoms, $R_2$ independently of one another hydrogen or an alkyl group with 1 to 5 carbon atoms and x is an integer from 1 to 6.

According to another embodiment of the invention the basic function is an imine or a basic, aromatic N-containing group, preferably a pyridine group or an imidazole group.

According to a further embodiment the pH-sensitive polymer is a polymer derived from chitosan.

The invention finally proposes that the compound comprises K-carrageenan.

According to an embodiment of the invention the core or cores comprise at least one material selected from the group consisting of fragrances, fabric softeners, antistatic agents, agents for restoring the capacity of washing to absorb moisture, mild acids, bleaches, disinfectants, agents for persistent protection of both the washing and the person wearing it against insects or mites, agents for the improved removal of grease marks, agents for finishing with protection against creasing, optical brighteners, ironing auxiliaries, agents for inhibiting dye transfers and enzymes.

In an alternative the core or at least part of the cores can be in the form of an encapsulated liquid. In another embodiment the core or at least part of the cores is in solid form.

The invention also relates to a process for performing a washing cycle in a washing machine, in which the composition according to the invention is added at a suitable time during the prewashing cycle or main washing cycle to the medium located in the washing machine.

In a special embodiment of this process for the case that the basic composition in the form of a tablet is unable, following its dissolving in the medium to make available therein a concentration of the specific ion, up to the end of the main washing cycle, which is sufficiently high in order to prevent a substantial dissolving of the covering and a substantial detachment of the covering from the core or cores, said adequate concentration of the specific ion is brought about by he addition of a further composition, such as e.g. a detergent composition, to the medium of the main washing cycle at an appropriate time.

The composition according to the invention is characterized in that it delivers excellent results both in the main washing cycle and in the rinsing cycles of a washing machine. The basic composition e.g. in the form of a tablet is dissolved during the main washing cycle and can evolve its corresponding, intended action (cleaning, water softening, washing intensification, etc.). The particle according to the invention contains as the core material the substance or substances having to evolve their main function in the rinsing cycles of the washing machine. Said substance or substances are protected by a covering which, at the concentration of the specific compound, e.g. the pH-value, and the temperature of the main washing cycle, is stable and dissolves or is detached either insignificantly or not at all.

Following the main washing cycle and the pumping out of the washing liquor a dilution effect occurs in the rinsing cycles through the repeated entry of fresh water, so that the concentration of the specific compound drops significantly. Obviously the actual course of this concentration change in the washing cycle of a washing machine is greatly dependent on the composition of the detergent used. The following table 1 shows in exemplified manner a pH-profile measured in the case of a CANDY Activa 80

Plus washing machine, with a 60° washing program with 3 kg of fabrics having a normal dirtiness level and 3 standard 40 g detergent tablets, as described in detail hereinafter (example 4 ).

TABLE 1

| | Time (min) | pH-value |
|---|---|---|
| Main washing cycle | 10 | 10.35 |
| | 20 | 10.30 |
| | 30 | 10.28 |
| | 40 | 10.27 |
| | 50 | 10.27 |
| | 60 | 10.27 |
| | 70 | 10.27 |
| | 80 | 10.25 |
| | 90 | 10.25 |
| First rinsing cycle | 103 | 9.93 |
| Second rinsing cycle | 109 | 9.50 |
| Third rinsing cycle | 119 | 8.90 |
| Fourth rinsing cycle | 128 | 8.50 |

It is clear throughout the main washing cycle there is a relatively high pH-value of 10.25 to 10.35, which by the fourth rinsing cycle has dropped to 8.50. The solubility of the covering material must consequently be reduced to such an extent at pH-values of preferably below 9 that it rapidly dissolves or is detached and that the effective core material is released into the surrounding medium, i.e. the rinsing water.

It is essential that the protection of the core material is effective from the addition to the composition according to the invention to the water up to the start of the rinsing cycles, i.e. also before the washing liquor reaches a sufficiently high concentration of the specific compound, as will be explained hereinafter.

As an alternative to the preferably used tablet form of the basic composition other administration forms are possible and covered by the protective scope of the present invention. Thus, the particles with the covering variable in its solubility in response to a change in the concentration of the specific composition can be connected by a granulation or similar process to the basic composition, can e.g. be enveloped. In order to ensure for the said embodiment an optionally desired reduced contact between the covering and the basic composition, the particles can be surrounded with a further protective jacket, which e.g. comprises a compound soluble in water independently of the concentration of the specific compound. With this embodiment during the main washing cycle once again firstly the basic composition and the protective jacket of the particles were dissolved and once again the particles protected by the covering according to the invention were left behind.

Provided that there is to be no charging by special dosing aids able to retain the particles according to the invention, the particles according to the invention must be chosen sufficiently large that they are not discharged to a significant extent during pumping out of the washing machine following the main washing cycle and the first rinsing cycles or charging by charging devices.

The invention is described in greater detail relative to the following examples and the drawings, wherein show:

FIG. 1 A first embodiment of the composition according to the invention in cross-section.

Figure 2:
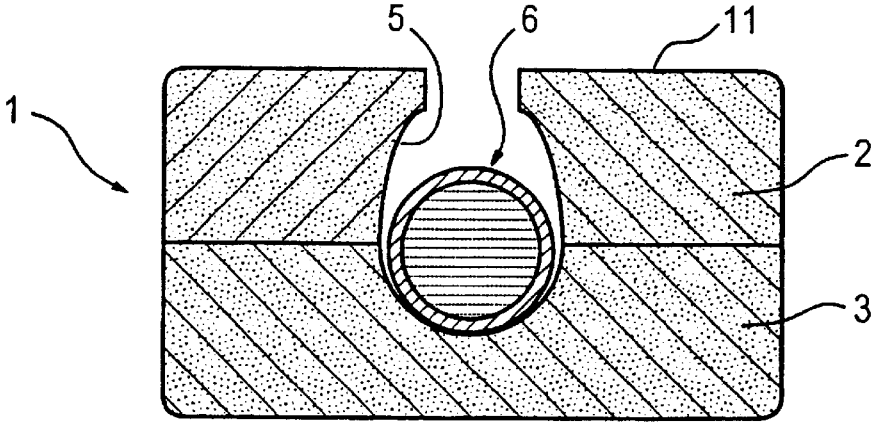

FIG. 2 A second embodiment of the composition according to the invent ion in cross-section.

Figure 3:
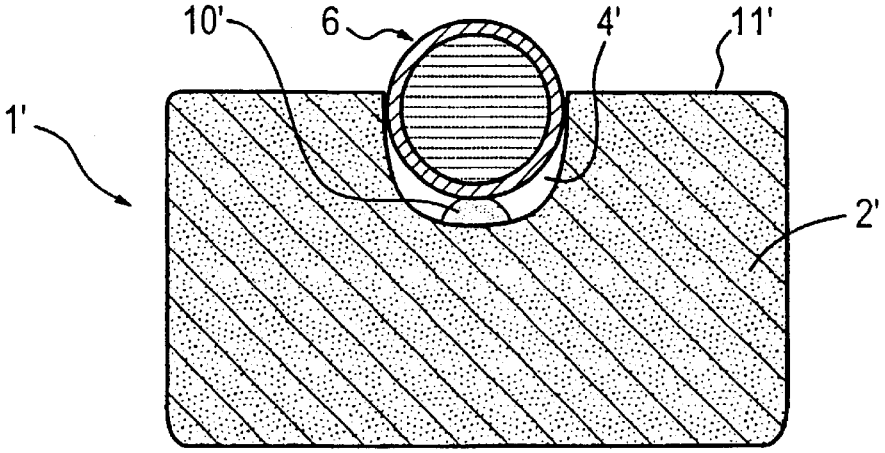

FIG. 3 A third embodiment of the composition according to the invention in cross-section.

Figure 4A:
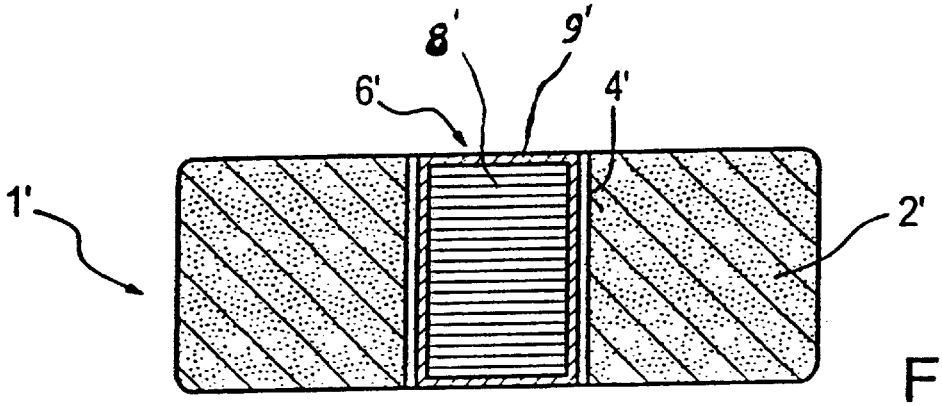
Figure 4B:
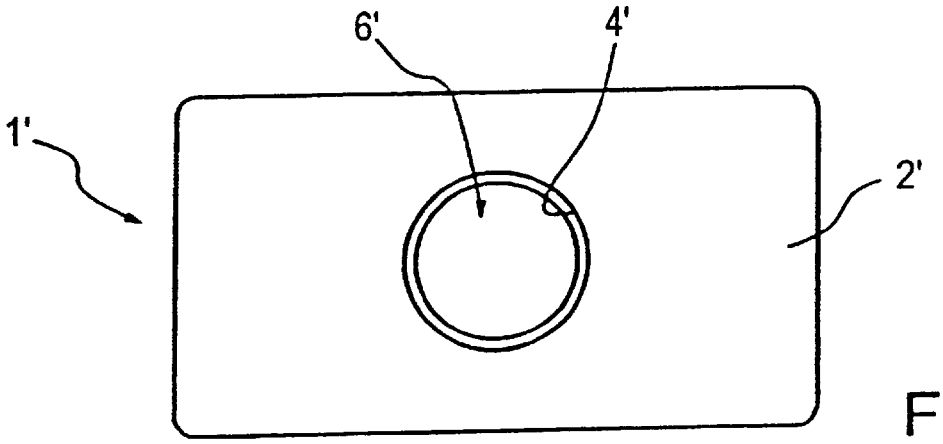

FIGS. 4*a* & *b* A fourth embodiment of the composition according to the invention in cross-section and in plan view.

Figure 5:
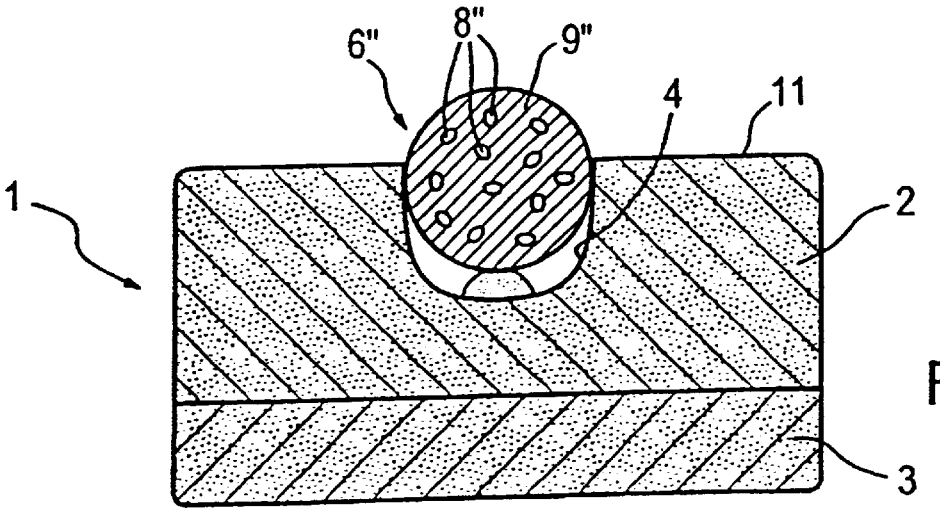

FIG. 5 A fifth embodiment of the composition according to the invention in cross-section.

FIGS. 1 to 5 constitute possible embodiments of the composition according to the invention. In all cases for illustration the preferred tablet form is chosen.

FIG. 1 shows a tablet 1 comprising two half-tablets 2, 3, which can have different or identical compositions. Roughly centrally in both half-tablets there is a roughly hemispherical recess 4, 5, which when the tablet 1 is combined together give a roughly spherical cavity.

In the represented embodiment said cavity receives a single particle 6 comprising the core 8 and covering 9, whose external diameter is slightly smaller than the internal diameter of the tablet cavity. In another embodiment of the invention particles 6 can also completely fill the cavity of the tablet and engage on the walls thereof. If the internal diameter of the cavity is slightly larger than the external diameter of the particles 6, the latter can either be loosely received in the cavity or fixed by an adhesive applied in the gap.

In the embodiment in which the contact between the particle and the basic composition surrounding it is reduced or completely prevented, the additional advantage arises that during production processes, e.g. the moulding of the individual ingredients in successive stages, a deformation and possibly resulting damage to the core or cores and/or the covering is reliably prevented and which could give rise to a reduction in the protective action of the core covering. By preventing any pressure being exerted on the particle during any phase of the production process, it is possible to reliably ensure that with a specific composition of the core or cores there is no "bleeding" thereof into the material of the covering and basic composition. It can be advantageous with certain compositions of the covering 9 and/or basic composition 2, 3, to avoid an intimate, full-surface contact, because otherwise undesired reactions could occur in the boundary layers.

In a preferred embodiment of the invention the surface of the particle is at the most in partial direct contact with the surface of the tablet basic composition surrounding it. This can take place in the manner specifically described in the application, but also in other ways achieving the sought objective. Examples are the loose arrangement of the smaller particle in a larger cavity, the fixing of a smaller particle in the larger cavity in such a way that there is no or only a partial contact between the particle and the basic composition, the application of a protective coating over the core covering according to the invention, etc.

In conjunction with the inventive particle, the expression "local environment" means the direct environment around said particle. The concentration of the specific compound in said local environment of the particle is the determinative factor for its stability. In preferred embodiments in tablet form said concentration in the local environment of the particle is determined at least up to a substantially complete dissolving of the tablet by said molecule passing into solution. Thus, at least in the initial phase of the main washing cycle, the origin of the "specific compound" is a compound from the basic composition forming the tablet or is produced by the latter in the surrounding medium. In the most typical case the basic, standard detergents are $OH^-$ ions, whose concentration can be expressed as a pH-value.

If the basic composition is not constituted by an e.g. basic detergent composition, but instead e.g. by a water softener composition or a washing intensifier composition, the protection of the covering of the particle by a sufficiently high concentration of the specific compound in the local environment of the particle is possibly only ensured until the basic composition, e.g. the tablet is completely dissolved, namely in cases where the basic composition is unable to make available a sufficiently high, corresponding concentration in the washing liquor. In such cases the sufficiently high concentration in the washing liquor (and therefore in the local environment of the particle or particles) is brought about by dissolving the detergent (or a further specific additive).

For fixing the particle in the cavity it is obviously not only possible to use a conventional adhesive, but also other compositions and agents fulfilling the same function, e.g. a mechanical fixing such as e.g. adequate frictional engagement between tablet and particle at at least certain points or a plug connection between tablet and particle. Fixing agents between the particle and tablet can also be constituted by compounds which preferably melt or dissolve during the main washing process.

Obviously, the most varied further geometrical shapes, such as e.g. ellipsoid, cylinder, etc. are possible for the design of the cavity in the tablet or the particle received therein. The design and size of the tablet cavity and that of the particle received therein need not correspond with one another. Thus, e.g. a spherical cavity can receive a cylindrical particle. All possible further combination possibilities are conceivable within the scope of the present invention. It is also possible to fill the cavity with several smaller particles instead of a single particle.

FIG. 2 shows a second embodiment of the inventive composition based on a conventional two-layer tablet 1. In this case the upper half-tablet 3 comprises two parts, which make available both an adequate cavity 5 for receiving the particle 6 and an opening to the tablet side 11. Thus, in this case the particle 6 is not completely surrounded by the basic composition of the tablet 1, so that it is visible from the outside in the interior of tablet 1. Here again the particle can either be loosely received in the cavity 5 (provided that it is ensured by a corresponding choice of the size of the particle 6 on the one hand and the size of the opening of the cavity 5 towards tablet side 11 on the other that the particle or particles in the cavity cannot pass through the opening) or can be fixed in the interior of the cavity 5 by a corresponding agent, such as e.g. an adhesive.

FIG. 3 shows a third possible embodiment, once again based on a two-layer tablet. By means of a suitable device a depression 4 is formed in the upper layer 2. Into said depression 4 is introduced the particle 6, which in this case, because the depression is open to such an extent to the side 11 of the tablet 1 that without fixing the particle might drop out of the depression, is fixed with an adhesive 10 or a fixing intermediate layer or mechanically (e.g. by frictional engagement) in the depression. This principle can obviously also be applied to single-layer tablets.

Here again the most varied geometrical configurations are possible. Thus, e.g. parallel to side 11, the depression can have a substantially circular cross-section. However, numerous other cross-sections are conceivable, e.g. any random polygon. The particle 6 received in the depression 4 can, as in the embodiment according to FIG. 2, assume any random shape (independent of the shape of the depression 4), such as e.g. an ellipsoid, cylinder, parallelepiped, etc.

Consideration can also be given to fixing the particle 6' in a tablet cavity open on both sides, in the tablet, such as in a cylindrical hole 4' passing through a tablet body 1' comprising a layer 2' and in which is fixed a corresponding cylindrical particle 6' having a core 8' and a covering 9' (FIGS. 4*a* and *b*).

Another possible embodiment can be gathered from FIG. 5. The latter is substantially built up in the same way as the embodiment according to FIG. 3. However, in the present case the particle 6" contains not one core (as in FIG. 3), but a plurality of cores 8", which are all embedded in a covering 9". In this embodiment it is e.g. also possible to incorporate into a particle 6" cores having a different composition and different shape (encapsulated material or solid cores).

Both in the represented embodiments and also in further conceivable alternatives it is important that for the particle containing the substance or substances to be released during the rinsing cycles, at least in the first phase of the main washing cycle, there is a local environment with an adequate ionic concentration or pH-value which can serve as a "trigger" for dissolving the covering, i.e. in a phase in which the detergent composition has not yet adequately dissolved, i.e. the pH-value is still relatively low, i.e. temporarily in an area with an increased solubility of the covering. This ensures that the covering has an adequate stability up to the rinsing cycles.

EXAMPLE 1

Production of the Core a. Core for a Particle for the Controlled Release of Acid in the Rinsing Cycle The release of an acid in the rinsing cycles of a washing machine serves both to remove incrustations and for neutralizing alkaline residues. Advantageously use is made for this purpose of weak acids, such as amidosulphuric acid and/or maleic acid. These materials are conventionally solids, which can be directly provided with the intended covering and the coating process must optionally be matched to the corresponding substance or substances.

In the production process a mixture of 1.05 g of amidosulphuric acid and 0.45 g of maleic acid are shaped to a tablet in a rotary press under a pressure of 890 kg/cm$^2$.

b. Core for a Particle for the Controlled Release of a Fragrance in the Rinsing Cycle Whilst taking account of similar considerations to those of example 1a, a corresponding core is produced in the following manner. 0.1975 g of fragrance-are absorbed on 0.0525 g of finely divided silica, in order to give a free-flowing, granular material. The resulting 0.25 g are mixed with 0.6 g of microcrystalline cellulose and 0.15 g of cross-linked polyvinyl pyrrolidone. The mixture is tabletted in a circular press with an internal diameter of 10 mm under a pressure of 2900 kg/cm$^2$ in order to provide an elliptical tablet with a height of 13.1 mm and a weight of approximately 1 g.

Alternatively fragrances, normally in the form of liquids, can be provided as fragrance-containing capsules.

c. Core for a Particle for the Controlled Release of Chlorine Bleach in the Rinsing Cycle Chlorine bleach is used in the rinsing cycle of a washing machine for improving the cleaning action and also simultaneously has a disinfecting action.

Taking account of the considerations of examples 1a and 1b, such cores can be produced in the following way. 1 g of chlorine bleach, e.g. pure sodium dichloroisocyanurate, can be pressed to a tablet in a suitable press under a pressure of 5600 kg/cm$^2$.

d. Core for a Particle for the Controlled Release of a Fabric Conditioning Activity in the Rinsing Cycle In the present example the core comprises several substances, which are to evolve their given actions in the rinsing cycle of a washing machine. In the present case it is specifically a combination of a fabric softener, an agent for reducing the build-up of static electricity in the fabric and an agent for improving the renewed fabric moisture absorption.

A suspension of 58% urea, 18% dimethyl distearyl ammonium chloride (DMDSAC) (90%), 8% of a $C_{9-11}$ alcohol, ethoxylated with 9 mole of ethylene oxide and 16% of water was prepared. The suspension was spray-dried in order to give a granular material with a density of 580 g/l and the following composition: 68.8 wt. % urea, 19.2 wt. % DMDSAC, 9.5 wt. % nonionic surfactant and 2.5 wt. % water.

4 g of the granular composition were mixed with 1 g of cellulose. The mixture was tabletted in a circular press with an internal diameter of 25 mm and a pressure of 80 kg/cm$^2$ in order to give an elliptical tablet with a height of 14 mm and a weight of 5 g.

EXAMPLE 2

Screening Process for Covering Materials

As stated hereinbefore, it is of vital significance for the present invention that the material for covering the particle core or cores comprising the substance evolving its function essentially during the rinsing cycle, has a solubility which is dependent on the concentration of a specific, selected ion. In this way the covering is substantially insoluble in the main washing cycle and is made soluble and detaches from the particle if the concentration drops during the rinsing cycles.

It has been observed that the dilution resulting from the pumping out of washing liquor and the inflow of fresh water during the different rinsing cycles leads to the concentration dropping by 20 to 200 times between the end of the main washing cycle and the last rinsing cycle.

On the basis of this observation a process for screening the suitability of different polymers for their use as covering materials was developed, which is based on the determination of the solubility of such polymers at two different concentrations, which are at least 20 times and preferably 200 times apart.

The values for the concentration to be used during polymer screening, are dependent on the formulation of the basic composition of the tablet in which the enveloped particle is to be incorporated.

In fact, the value for the highest concentration to be used for the screening process should correspond to the concentration of the selected ion encountered in the washing liquor, after the detergent has completely dissolved. When this concentration has been determined, the lower value for the concentration should be fixed at 20 to 200 times below said higher value.

On the basis of this information at falls within the routine capacity and knowledge of an expert in this field to determine the values for the concentration of the test solutions to be used in the testing processes described hereinafter.

Process for the Preparation of the Test Solution and for Performing and Evaluating the Test The materials to be tested are dissolved in solvents, in which they are readily soluble. The solutions are spread over glass plates and subsequently dried at room temperature until they have a constant weight.

At a controlled temperature the glass plates are paced in a beaker with the test solution. The solution is ten stirred with a magnetic stirrer at a controlled stirring rate. After about 10 minutes the glass plates are removed from the beaker and dried at room temperature to a constant weight. The results are expressed as a weight loss (%)

Obviously the screening processes must be adapted to the composition of the detergent, because this exerts the essential influence on the concentration or pH-profile in the washing cycle. The aim in all cases is to check the degree of solubility of the corresponding materials at different states, namely high or low concentration or pH-value.

On the basis of this information it falls within the routine capacity of an expert in this field to provide the specific test parameters for the screening. For example, hereinafter two screening processes are described with some of the possible materials for the covering of the particles.

Screening Process 1

Screening process 1 was carried out with buffer solutions as the medium for simulating the washing liquor. To this end two buffer solutions were prepared in the following way:

| | |
|---|---|
| Stock solution: | 7.507 g glycine buffer (Merck 104169)<br>5.850 g NaCl<br>topped up with water to 1000 ml |
| pH 8-buffer solution: | 500 ml stock solution<br>500 ml distilled $H_2O$<br>1.23 g 1N NaOH |
| pH 10-buffer solution: | 500 ml stock solution<br>500 ml distilled $H_2O$<br>32.6 g 1N NaOH. |

Screening Process 2

Screening process 2 was performed with the following detergent formulation in order to simulate the conditions in different stages of a washing cycle.

Detergent Formulation

Firstly a spray-dried basic material with the following composition was prepared:

TABLE 2

| Ingredient | wt. % |
|---|---|
| Sodium carbonate | 7.43 |
| Sodium LAS | 40.0 |
| Zeolite | 17.70 |
| Polymer | 7.0 |
| Sodium sulphate | 9.61 |
| Sodium-silicate | 7.00 |
| Soap | 4.0 |
| Phosphonate | 1.55 |
| Carboxymethyl cellulose | 1.01 |
| Water and others | 4.7 |

This spray-dried basic composition was mixed with the further, following ingredients in order to obtain the final formulation:

TABLE 3

| Ingredient | wt. % |
|---|---|
| Spray-dried basic material | 22.6 |
| Sodium percarbonate | 20.0 |
| Sodium carbonate | 19.58 |
| Sodium tripolyphosphate | 17.42 |
| Microcrystalline cellulose | 6.0 |
| Alkyl sulphate | 6.0 |
| Polymer | 1.50 |
| Cross-linked polyvinyl pyrrolidone | 1.80 |
| Enzymes | 1.78 |
| TAED | 1.00 |

TABLE 3-continued

| Ingredient | wt. % |
|---|---|
| Polyethylene glycol | 0.18 |
| Water and others | 2.14 |

Screening Process 3

Screening process 3 is used for screening for compounds, whose solubility changes as a function of the concentration of potassium ions. The compounds revealed by such screening processes can be used if in the main washing cycle, as described hereinbefore, there is a correspondingly high potassium ion concentration, which is correspondingly reduced by dilution in the rinsing cycles.

Screening process 3 was carried out with the following formulation in order to simulate corresponding conditions. Formation

| Ingredient | wt. % |
|---|---|
| Potassium tripolyphosphate | 13.6 |
| Potassium bicarbonate | 34.0 |
| Potassium sulphate | 23.1 |
| Potassium chloride | 12.4 |
| Potassium carbonate | 9.7 |
| Boric acid | 2.0 |
| Sodium perborate monohydrate | 2.0 |
| TAED | 1.0 |
| Paraffin | 1.0 |
| Protease | 0.2 |

EXAMPLE 3

Selection of Materials for Covering the Particles

Using the screening process described in example 2 various materials were tested for their suitability as a covering for the particles according to the present invention. One of these materials, hereinafter "polymer 1" is a polymer of the type described in Japanese patent application KOKAI 61-28440, i.e. a polymer of general formula II with l/(l+m+n)=0.35; m/(l+m+n)=0.45; l+m+n=1500–1800.

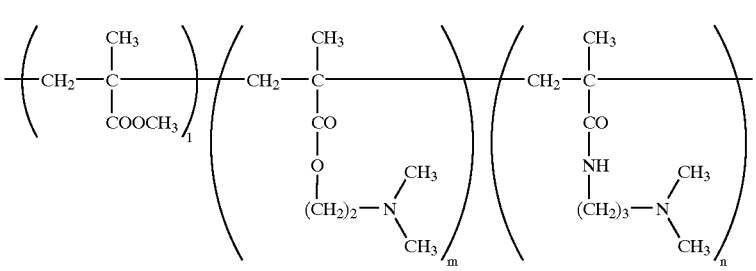

(II)

The polymer was produced in the conventional manner by bulk polymerization. The screening test results were as follows:

Screening Process 1:

Films of polymer 1 were produced from a 10% solution in isopropanol.

| pH-value of buffer solution | Weight loss of 30° C. (%) | Weight loss at 60° C. (%) |
|---|---|---|
| 10 | 7–8 | 5–8 |
| 8 | 81–88 | 91–95 |

Screening process 2 gave similar results.

The invention is obviously not restricted to this exemplified polymer and naturally a considerable variation possibility exists with respect to the polymers mentioned in Japanese patent applications KOKAI 60-141705, 61-28440, 61-28441, 61-28596, 61-28597 and 61-28598 or can be extended to compounds of formula IV:

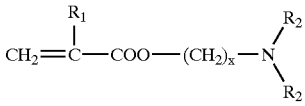

(IV)

in which $R_1$ independently of one another is hydrogen or an alkyl group with 1 to 3 carbon atoms, $R_2$ independently of one another is hydrogen or an alkyl group with 1 to 5 carbon atoms and x is an integer from 1 to 6.

In addition, within the larger class of compounds according to formula III:

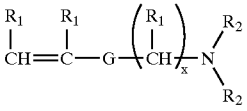

(III)

in which G is a link group selected from —COO—, —OCO—, —CONH—, —NHCO—, —NHCONH—, —NHCOO—, —OCONH— or —OCOO—, $R_1$ independently of one another is hydrogen or an alkyl group with 1 to 5 carbon atoms and x is an integer from 1 to 6, in exemplified manner it is possible to use polymers with a repeat unit based on a compound of formula V:

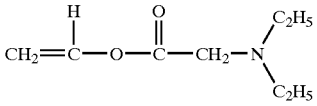

(V)

e.g. a pH-sensitive polymer ("Polymer 2") with the repeat unit VI, which is commercially available from SANKYO under the trade name AEA®:

(VI)

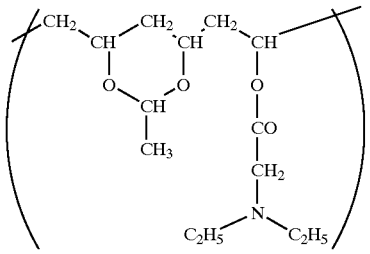

The above-described screening process 2 was also performed with "Polymer 2":

15 g of "Polymer 2" and 5 g of Mowiol® 3-98 (Clariant) were dissolved in 200 ml of a mixture of water/ethanol/1 N HCl 12:8:1. Films were formed and tested, in the manner described hereinbefore. The results were comparable with those for "Polymer 1".

Further polymers having the desired characteristics or which can be modified in a simple manner so that they are suitable for the purposes of the present invention are polymers of isomers or derivatives of pyridine, preferably copolymers with styrene or acrylonitrile, according to the following formulas VII and VIII, in which G is a substituent at a random point of the pyrridine ring:

(VII)

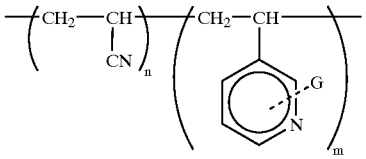

(VIII)

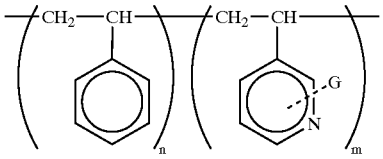

A polymer according to the above formula VIII, namely poly(4-vinylpyridine-styrene) copolymer (Scientific Polymer Products Inc.), namely "Polymer 3" was tested in accordance with the above-described screening process 2:

10 g of "Polymer 3" were dissolved in 230 ml of water/1N HCl 6.25:1. The films were formed and the tests carried out in the manner described herein-before. The results were comparable with those for "Polymer 1" and "Polymer 2".

Further polymers are (e.g. random) polymers derived from chitosan, based on the following monomer units IX and X:

(IX)

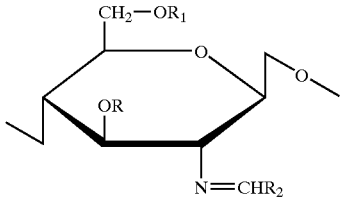

-continued (X)

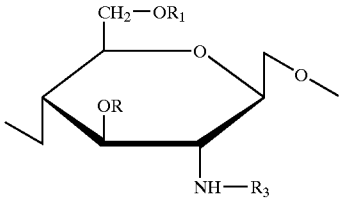

In addition, it is also possible to use in the core material covering substances or substance mixtures which, with respect to their solubility behaviour, react to a change in the ionic concentration, i.e. ionic concentration-sensitive polymers. Consideration for this purpose can e.g. be given to the partly hydrolyzed polyvinyl acetates (commercially available under the trade mark Mowiol®—Clariant) described in EP 284 191 A2 and EP 284 334 A2 and which reveal a corresponding ionic concentration dependence in the presence of borates due to the complexing of the borates with polyols. The first successful tests were performed with Mowiol® 56-88.

A further ionic concentration-sensitive polymer is the polysaccharide K-carrageenan, which was proved to be in screening process 3 (cf. example 2) a polymer whose solubility is dependent on the potassium ion concentration in the surrounding medium. K-carrageenan is represented by the following formula XI:

(XI)

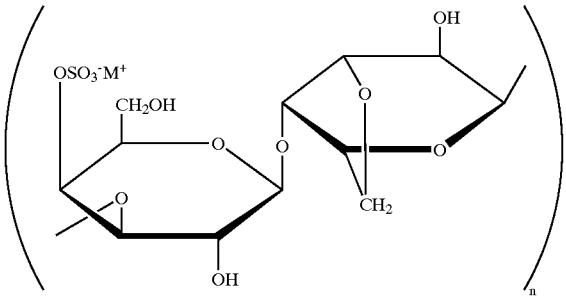

This polymer, known as "polymer 4", was tested in accordance with the above-described screening process 3:

4 g of K-carrageenan were dissolved in 96 g of water. 10 g of Mowiol® 18-88 were dissolved in 90 g of water and both solutions were mixed together. The resulting solution was used for the formation of films and the performance of tests in the manner described herein-before. The following results were obtained:

| Concentration cleaning agent | Weight loss at 30° C. (%) | Weight loss at 60° C. (%) |
|---|---|---|
| 4 g/l | 0.5–0.3 | 11.0–12.0 |
| 0.02 g/l | 24.5–25.0 | 78.0–85.0 |

The above list of compounds which are suitable for the inventive covering is obviously non-exhaustive. Further polymers, which change their solubility by modifying the concentration of a specific compound, e.g. the pH-value in the desired range are conceivable or can be developed and are consequently also covered by the protective scope of the invention. Inter alia, for the covering according to the invention it is also possible to consider compounds which, with respect to their solubility behaviour react to the change in the concentration on nonionic compounds in the surrounding medium. The substances suited for the inventive covering are not limited to polymeric compounds, although they are described here as preferred embodiments.

With the aid of the aforementioned screening processes or screening processes adapted to the measurement of an ionic concentration sensitivity, it is possible to test for their suitability in the present invention various other commercially available materials or materials obtainable by simple modifications. In view of the clear aims set and the indicated screening processes, the choice of such polymers is a problem which can be solved without difficulty by the average expert.

EXAMPLE 4

Production of a Particle According to the Invention

The different cores described in example 1 were uses as a basis for producing the particle according to the invention. These cores were individually or in plurality (FIG. 5) provided with a covering in an apparatus for the application of a film coating, such as is known from the pharmaceutical industry (e.g. from Lodige, Huttlin, GS, Manesty ant Driam).

In the case where the core or cores have an ingredient revealing a certain incompatibility with the material of the covering, prior to the application of said covering the core or cores can be initially provided with a protective coating. For this purpose use can be made of various prior art materials such as e.g. cellulose, cellulose derivatives, polyvinyl alcohol, polyvinyl alcohol derivatives and mixtures thereof. When using the cores of example 1, in cases 1*a*, 1*b* and 1*c* such a protective coating was used, namely a 10 wt.% aqueous solution of the polyvinyl alcohol Mowiol® 5-68 (Clariant). In the case of example 1*a* the core was coated with 0.76 g of such a solution, whereas in example 1*b* 0.40 g of the same solution was used and in example 1*c* 0.29 g of the same solution was used.

The covering can fundamentally be applied in any random quantity and thickness to the core or cores or the protective coating, provided that it is ensured that the covering sufficiently rapidly dissolves or is detached during the rinsing cycles to enable the substance or substances contained in the core or cores to evolve their action. In a preferred embodiment to the cores are applied 1 to 10, preferably 4 to 8 wt. % of the ionic concentration-sensitive covering material (solids), based on the weight of the complete Preferably the particles according to the invention should have a size such that they are not or at least not to a significant extent discharged from the washing machine through the pumping out processes following the main washing cycle or the individual rinsing cycles. For this purpose normally a maximum diameter of approximately 1 cm is adequate. Smaller or larger dimensions can obviously also be chosen, provided that operation is ensured.

For the further tests "polymer 1" from example 3 was used as the covering and applied as a 10% polymer solution 0.055 N aqueous HCl.

Example 5

Production of a Tablet with the Particle According to the Invention

In exemplified manner hereinafter the production of a one or two-layer tablet, in which both layers have the same composition, is described. Such a tablet can be produced by moulding the pulverulent ingredients in machines known from the prior art and using the operating parameters known from the prior art. The composition of such a tablet is based on commercially available products. For example, hereinafter a detergent tablet, a water softener tablet and a washing intensifier tablet are described.

Detergent Tablet

The composition mixture for a detergent tablet can e.g. be based on a detergent formulation as represented in example 2, tables 2 and 3. The resulting granular composition has a bulk density of approximately 690 g/l and can be tabletted under a pressure of 21 kg/cm$^2$ in order to give a half-tablet with a depression and weighing approximately 20 g.

An inventive particle produced according to example 1 and 4 is introduced into the half-tablet recess. Subsequently a fixing substance e.g. an adhesive (e.g. polyethylene glyccl, polyvinyl ether, polyvinyl alcohol, silicate, preferably melted PEG 4000) is applied to the corresponding face of the half-tablet and optionally also to the particle and the second half-tablet is pressed onto the first half-tablet with the particle according to the invention. This gives a detergent tablet with a commercially convectional weight of about 40 g.

Water Softener Tablet

The following ingredients were mixed:

TABLE 4

| Ingredient | wt. % |
|---|---|
| Sodium carbonate | 20 |
| Trisodium citrate | 20 |
| Polymer | 18.5 |
| Schist silicate | 10 |
| Microcrystalline cellulose | 10 |
| Polyethylene glycol 6000 | 10 |
| Phosphonate | 3 |
| Water | 8.5 |

The resulting granular composition was tabletted under a pressure of 150 kg/cm$^2$ in order to give a half-tablet with a recess and weighing approximately 8 g.

The placing round the particle according to the invention and the joining together of the half-tablets took place in the manner described for the detergent tablet.

Washing Intensifier Tablet

Using known technology for producing a two-layer tablet a washing intensifier tablet is produced, whose differently heavy layers (26/74) have a different composition in accordance with the following table:

TABLE 5

| Ingredient | First layer (26%) wt. % | Second layer (74%) wt. % |
|---|---|---|
| Sodium percarbonate | | 75.93 |
| Citric acid | 17.50 | 5.13 |
| Microcrystalline cellulose | 7.00 | 7.00 |
| Schist silicate | 5.00 | 5.00 |
| Enzymes | 5.06 | |
| Sodium bicarbonate | 9.94 | 1.37 |
| TAED | 50.00 | |
| Polyethylene glycol 6000 | 4.00 | 4.00 |
| Polyvinyl pyrrolidone | 1.50 | 1.50 |
| Miscellaneous | | 0.068 |

As shown in FIG. 3 a depression is formed in the upper layer in which initially an adhesive or the like is introduced, followed by the particle according to the invention.

The features of the invention disclosed in the description, claims and drawings can be essential to the implementation of the different embodiments of the invention, either singly or in random combination.

What is claimed is:

1. A composition for use in a laundry machine, comprising a tablet composition having a basic composition, the tablet composition performing its function in a main washing cycle of the laundry machine, a particle having a core and comprising a component performing its function in a rinsing cycle of the laundry machine, and a covering surrounding the core and comprising a compound whose solubility is inversely proportional to a concentration of a basic ion in a medium surrounding the particle, wherein the particle is arranged in or on the tablet such that only a portion of a surface of the particle directly contacts the tablet, and wherein the concentration of the basic ion caused by dissolution of the tablet composition in the main washing cycle is sufficiently high to prevent dissolution of the particle covering or detachment of the covering from the particle core up to a start of the rinsing cycle.

2. The composition according to claim 1, wherein the particle is coated with a substance which, independently of the concentration of basic ion in the surrounding medium, dissolves or separates during the rinsing cycle.

3. The composition according to claim 1, wherein the particle is received in a cavity of the tablet, and wherein the cavity encloses the particle.

4. The composition according to claim 3, wherein the cavity has a volume equal to a volume of the particle received therein.

5. The composition according to claim 3, wherein the cavity has a larger volume than a volume of the particle received therein.

6. The composition according to claim 5, wherein the particle is loosely arranged in an interior of the cavity.

7. The composition according to claim 5, wherein the particle is fixed in an interior of the cavity.

8. The composition according to claim 7, wherein the particle is fixed by an adhesive.

9. The composition according to claim 3, wherein the cavity is centrally arranged in an interior of the tablet.

10. The composition according to claim 3, wherein the cavity is spherical.

11. The composition according to claim 5, wherein the cavity is spherical and the particle is spherical.

12. The composition according to claim 1, wherein the particle is received in a cavity of the tablet, and wherein the cavity only partly surrounds the particle.

13. The composition according to claim 3, wherein the cavity is a depression in a surface of the tablet.

14. The composition according to claim 13, wherein the particle is so received in the cavity that it does not project beyond a surface of the tablet.

15. The composition according to claim 14, wherein the cavity contains only a single particle, and a volume of the particle is equal to a volume of the cavity.

16. The composition according to claim 15, wherein the cavity has a substantially circular mouth.

17. The composition according to claim 16, wherein the mouth of the cavity is smaller than a diameter the particle received therein.

18. The composition according to claim 17, wherein the particle is loosely arranged in the cavity.

19. The composition according to claims 17, wherein the particle is fixed in the cavity.

20. The composition according to claim 19, wherein the particle is fixed with an adhesive.

21. The composition according to claim 1, wherein the tablet composition is selected from the group consisting of a detergent composition, a water softener composition, a washing intensifier composition, and combinations thereof.

22. The composition according to claim 1, wherein the covering comprises a compound which is soluble in a medium of the rinsing cycle such that it becomes dissolved or detached from the particle core to allow release of a material of the core into the medium of the rinsing cycle.

23. The composition according to claim 22, wherein a solubility of the compound is inversely proportional to hydroxide ion concentration in the surrounding medium.

24. The composition according to claim 23, wherein at a pH-value above 10 the compound has no or only a limited solubility and at a pH-value below 9 the solubility is such that the compound becomes dissolved or detached from the particle core.

25. The composition according to claim 22, wherein the compound comprises a polymer.

26. The composition according to claim 25, wherein the compound comprises a pH-sensitive polymer incorporating a repeat unit, which has a basic function separate from a backbone chain of the polymer.

27. The composition according to claim 26, wherein the repeat unit is based on a compound selected from the group consisting of vinyl alcohol derivatives, acrylates and alkyl acrylates having the basic function.

28. The composition according to claim 26, wherein the polymer is a carbohydrate functionalized with the basic function.

29. The composition according to claim 26, wherein the basic function is an amine.

30. The composition according to claim 29, wherein the amine is a secondary or tertiary amine.

31. The composition according to claim 29, wherein the repeat unit is based on a compound of formula III:

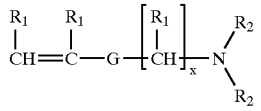

(III)

in which G is linking group selected from —COO—, —OCO—, —CONH—, —NHCO—, —NHCONH—, —NHCOO—, —OCONH—or—OCOO—, each $R_1$ is, independently, hydrogen or an alkyl group with 1 to 3 carbon atoms, each $R_2$ is, independently, hydrogen or an alkyl group with 1 to 5 carbon atoms, and x is an integer from 1 to 6.

32. The composition according to claim 29, wherein the repeat unit is based on a compound of formula IV:

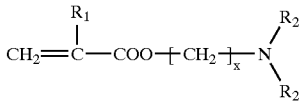

(IV)

in which $R_1$ is hydrogen or an alkyl group with 1 to 3 carbon atoms, each $R_2$ is, independently, hydrogen or alkyl group with 1 to 5 carbon atoms, and x is an integer from 1 to 6.

33. The composition according to claim 26, wherein the basic function is a basic aromatic N-containing group.

34. The composition according to claim 33, wherein the basic function is a pyridine group.

35. The composition according to claim 33, wherein the basic function is an imidazole group.

36. The composition according to claim 28, wherein the polymer is derived from chitosan.

37. The composition according to claim 23, wherein the composition comprises k-carrageenan.

38. The composition according to claim 1, wherein the core comprises a material selected from the group consisting of fragrances, fabric softeners, antistatic agents, agents for restoring a capacity of washed articles to absorb moisture, mild acids, bleaches, disinfectants, agents for permanent protection both of a washed article and a person wearing the washed article against insects or mites, agents for improved removal of grease stains, finishing agents giving protection against creasing, optical brighteners, ironing auxiliaries, agents for inhibiting dye transfer, enzymes, and combinations thereof.

39. The composition according to claim 38, wherein a portion of the core comprises an encapsulated liquid.

40. The composition according to claim 38, wherein the core is in solid form.

41. A process for washing articles in a laundry machine, comprising introducing into the laundry machine during a prewashing cycle or a main washing cycle a tablet composition comprising a basic composition, the tablet composition performing its function in a main washing cycle of the laundry machine, a particle having a core and comprising a component performing its function in a rinsing cycle of the laundry machine, and a covering surrounding the core and comprising a compound whose solubility is inversely proportional to a concentration of a basic ion in a medium surrounding the particle, wherein the particle is arranged in or on the tablet such that only a portion of a surface of the particle directly contacts the tablet, and wherein the concentration of the basic ion caused by dissolution of the tablet composition in the pre-washing or main washing cycle is sufficiently high to prevent dissolution of the particle covering or detachment of the covering from the particle core up to the start of the rinsing cycle.

42. The process according to claim 41, further comprising a step of introducing an additional detergent into the laundry machine during the main washing cycle.

* * * * *